United States Patent [19]

Lundström

[11] Patent Number: 4,591,850

[45] Date of Patent: May 27, 1986

[54] AUXILIARY MEMORY IN A VIDEO DISPLAY UNIT OF THE RASTER SCAN TYPE

[75] Inventor: Jan-Erik Lundström, Västerås, Sweden

[73] Assignee: ASEA Aktiebolag, Västerås, Sweden

[21] Appl. No.: 503,114

[22] Filed: Jun. 10, 1983

[30] Foreign Application Priority Data

Jun. 24, 1982 [SE] Sweden ..... 8203946

[51] Int. Cl.[4] ..... G09G 1/00

[52] U.S. Cl. ..... 340/799; 340/750; 340/747; 340/748

[58] Field of Search ..... 340/731, 745, 748, 744, 340/750, 798, 799, 747

[56] References Cited

U.S. PATENT DOCUMENTS

| | | | |
|---|---|---|---|
| 3,426,344 | 2/1969 | Clark | 340/798 |
| 3,609,743 | 9/1971 | Lasoff et al. | 340/799 |
| 3,928,845 | 12/1975 | Clark | 340/731 |
| 3,979,742 | 9/1976 | Kolb et al. | 340/748 |
| 4,117,473 | 9/1978 | Habeger, Jr. et al. | 340/750 |
| 4,163,229 | 7/1979 | Bodim et al. | 340/745 |
| 4,246,578 | 1/1981 | Kawasaki et al. | 340/799 |
| 4,357,604 | 11/1982 | Imazeki et al. | 340/731 |
| 4,357,671 | 11/1982 | Miller | 340/750 |
| 4,392,130 | 7/1983 | Lundström et al. | 340/747 |
| 4,419,662 | 12/1983 | Puskas et al. | 340/750 |
| 4,445,115 | 4/1984 | Nudgard | 340/745 |
| 4,459,677 | 7/1984 | Porter et al. | 340/750 |
| 4,498,081 | 2/1985 | Fukushima et al. | 340/799 |

*Primary Examiner*—Gerald L. Brigance

*Attorney, Agent, or Firm*—Pollock, Vande Sande & Priddy

[57] ABSTRACT

A visual (or video) display unit of the raster scan type has a symbol memory, where the dot patterns of the available symbols are stored, and a refresh memory, where information is stored which identifies the symbols present on the image in question and their positions on the image. An auxiliary memory constitutes a simplified reproduction of the refresh memory, for example with 1 bit for each word in the refresh memory. For each symbol on the image in question, the auxiliary memory defines, on the one hand, the element in the image which is written first during generation of the image, and on the other hand a definition element. In the place in the refresh memory, which corresponds to the position of the definition element in the image, there is stored a code which identifies the symbol.

6 Claims, 14 Drawing Figures

AUXILIARY MEMORY IN A VIDEO DISPLAY UNIT OF THE RASTER SCAN TYPE

TECHNICAL FIELD

The present invention relates to a device for the presentation of graphical information in the form of symbols of arbitrary size and in the form of dot matrices on a presentation unit, such as a visual (or video) display unit (VDU), of the raster scan type.

The device comprises a symbol memory, where information about the dot patterns of the available symbols is stored, and a refresh memory, where information about the position in the image, of the symbols included in the image in question, is stored.

DISCUSSION OF PRIOR ART

In VDUs of the above-mentioned type there are substantially two mutually contradictory demands for the structuring and storage of information in the refresh memory of the VDU.

One of these demands is imposed by the raster scan principle itself, and especially during regeneration of the image. When regenerating the image in a VDU of this kind, the electron beam typically starts at the upper lefthand corner of the VDU. The electron beam scans the VDU line by line from left to right, from top to bottom. Therefore, the electron beam always first reaches the upper lefthand corner of each symbol. To match this technique, therefore, the upper lefthand corner of the character should be written into the refresh memory.

When reading out the information of the VDU from the refresh memory, it is instead desired to read the code of each character or symbol on that line or that base line on which the character is logically written. Only in exceptional cases do these two coordinates coincide.

To be able to utilize the available surface area of a VDU in the most efficient way while retaining the greatest possible freedom for designing the VDU presentation, it is desirable to be able to use characters of different size and/or shape. With characters of this kind, however, the point of the character which is first reached by the scan, when the scan follows the line on which the character can logically be considered to have been written (the so-called "definition point") does not lie in a constant relation to the upper lefthand corner of the character. With VDUs with a possibility of presenting characters of different size and/or different shape, considerable difficulties will therefore arise in combining the demands for a simple reading out of the information contents of the image and a simple regeneration.

A further demand on a VDU of the kind stated is that the storing and clearing of individual characters or the entire image should be able to take place rapidly and in a simple manner.

OBJECTS OF THE INVENTION

One object of the invention is to provide a VDU of the kind described in the introduction, which satisfies the demands for simple and rapid refresh of the symbols on the VDU.

A further object of the invention is to provide a VDU which satisfies the demands for rapid read-out of the information contents of the VDU.

A still further object of the invention is to provide a VDU in which rapid and simple storing and clearing of characters or clearing of the whole VDU is possible.

SUMMARY OF THE INVENTION

The invention relates to a device for presenting graphical information in the form of dot matrix symbols of arbitrary size on a presentation unit of the raster scan type, which comprises a symbol memory, in which information about the dot pattern of the available symbols is stored, and a refresh memory, in which information is stored about the position in the image of the symbols included in the image in question.

The device is characterized in that it comprises an auxiliary memory, in which for an image there is stored for each symbol occurring on the image, information about the position in the image of, on the one hand, a start element for presentation of the symbol, the start element being that element of the symbol which is first wrtten during presentation, and, on the other hand, a definition element, identifying a position in the refresh memory, which corresponds to the position of the definition element in the image, storing a code which identifies the symbol.

BRIEF DESCRIPTION OF DRAWINGS

The invention will be further described, by way of example, with reference to the accompanying drawings, in which.

VDUs of the kind discussed here are already known, for example from U.S. Pat. No. 4,131,883, but these known VDUs are subjected to the drawbacks described above.

DESCRIPTION OF PREFERRED EMBODIMENT

Figure 1:
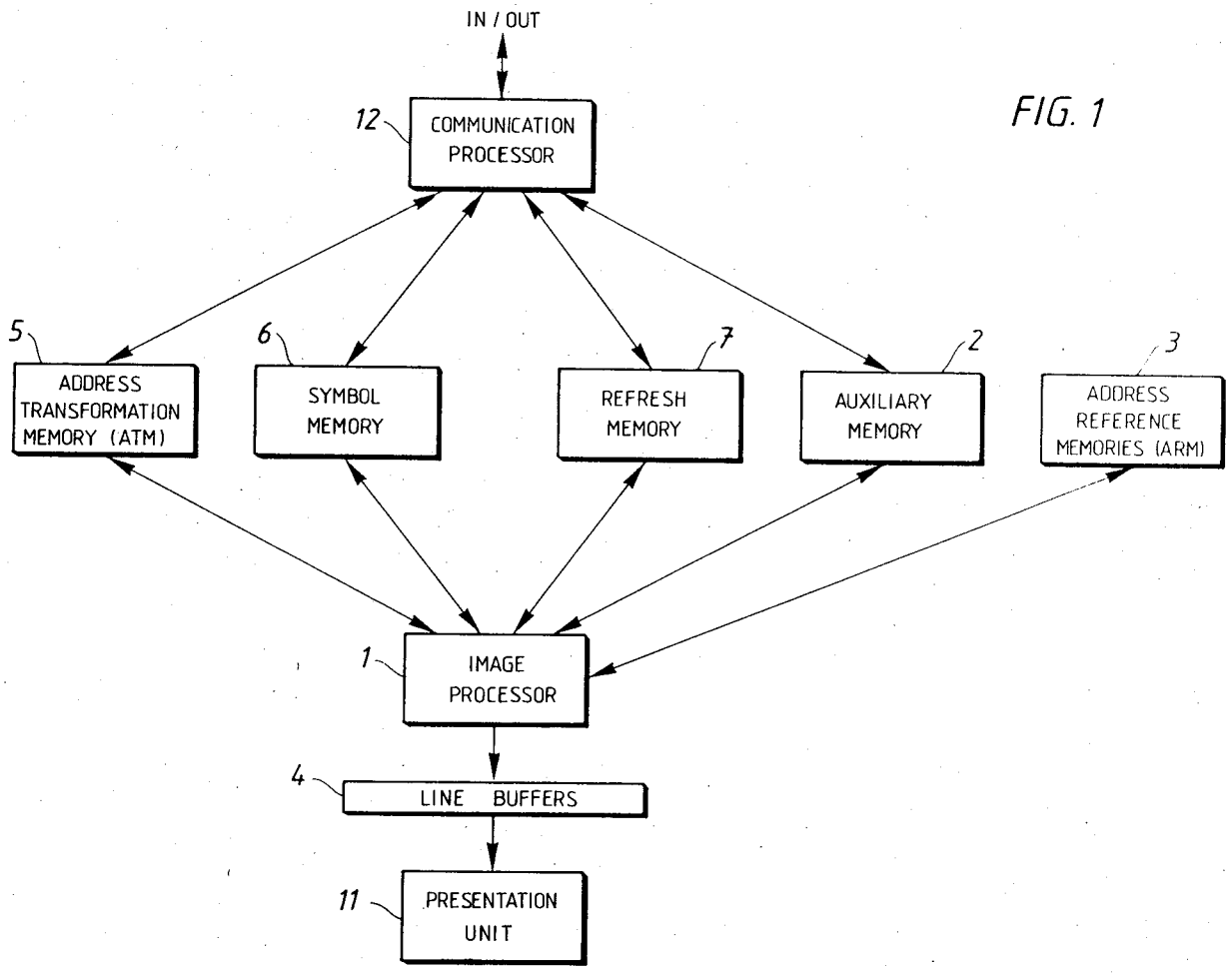
FIG. 1 shows schematically the build-up of a VDU according to the invention.

FIG. 1 shows an example of the schematic build-up of a VDU according to the invention. A communication processor 12, known per se, constitutes the communicating link between the VDU and the surroundings. The processor 12 controls the writing in of symbols on the VDU, the reading out of the information contents of the image and the clearing of the image or individual symbols. An address transformation memory 5 contains one word for each one of the symbols which may occur on the VDU. In each word there is stored the address of a certain symbol in the symbol memory 6. In the symbol memory 6 there is stored information which defines the appearance of each symbol on the VDU, whereby each symbol may be allocated arbitrary number of words in the symbol memory. When the address transformation memory 5 is addressed with the code of a certain symbol, there is obtained from the address transformation memory an address or a pointer which addresses the first field or word of the symbol in the symbol memory. A refresh memory 7 stores information about the appearance of the image currently written on the VDU. In the following, the VDU is assumed to be divided into units, so-called tessels, containing three times three picture elements (pixels). The refresh memory contains one word for each tessel on the VDU. This word contains information about the color of the tessel, about the symbol code for the symbol in question, and information about whether the tessel in question comprises the upper lefthand corner of the symbol or its point of definition. An auxiliary memory 2 constitutes a simplified reproduction of the refresh memory 7. The auxiliary memory contains one bit for each tessel, i.e. for each word in the refresh memory. Thus, the auxiliary memory is a memory with small dimensions compared with the refresh memory. Further, there are provided two address reference memories 3, which are used alternately. Each address reference memory has as many words as corresponds to the number of tessels on a line on the VDU. In the positions in the address reference memories which correspond to the leftmost tessel of each of those symbols which to some extent are situated on the line in question, the address to said tessel in the symbol memory is written in. Further, each word in the address reference memory contains information about the color of the symbol in question. An image processor 1, which may comprise a microprocessor and a couple of counters, an encoder and a register, controls the work of and the communication between the units 2, 3, 5, 6 and 7. The image processor also controls the reading out of image information to the presentation unit 11. The reading out takes place via three line buffers 4. Each line buffer contains the information which is necessary for presentation of a raster line on the VDU. For each image element on the raster line, the line buffer contains, on the one hand, information about whether the image element shall be light or dark and, on the other hand, information about the color of the image element. The three line buffers together cover three raster lines, i.e. one line of tessels. A presentation unit 11 comprises a cathode ray screen as well as necessary video circuits for presentation of the information, stored in the line buffers, on the VDU.

Figure 2:
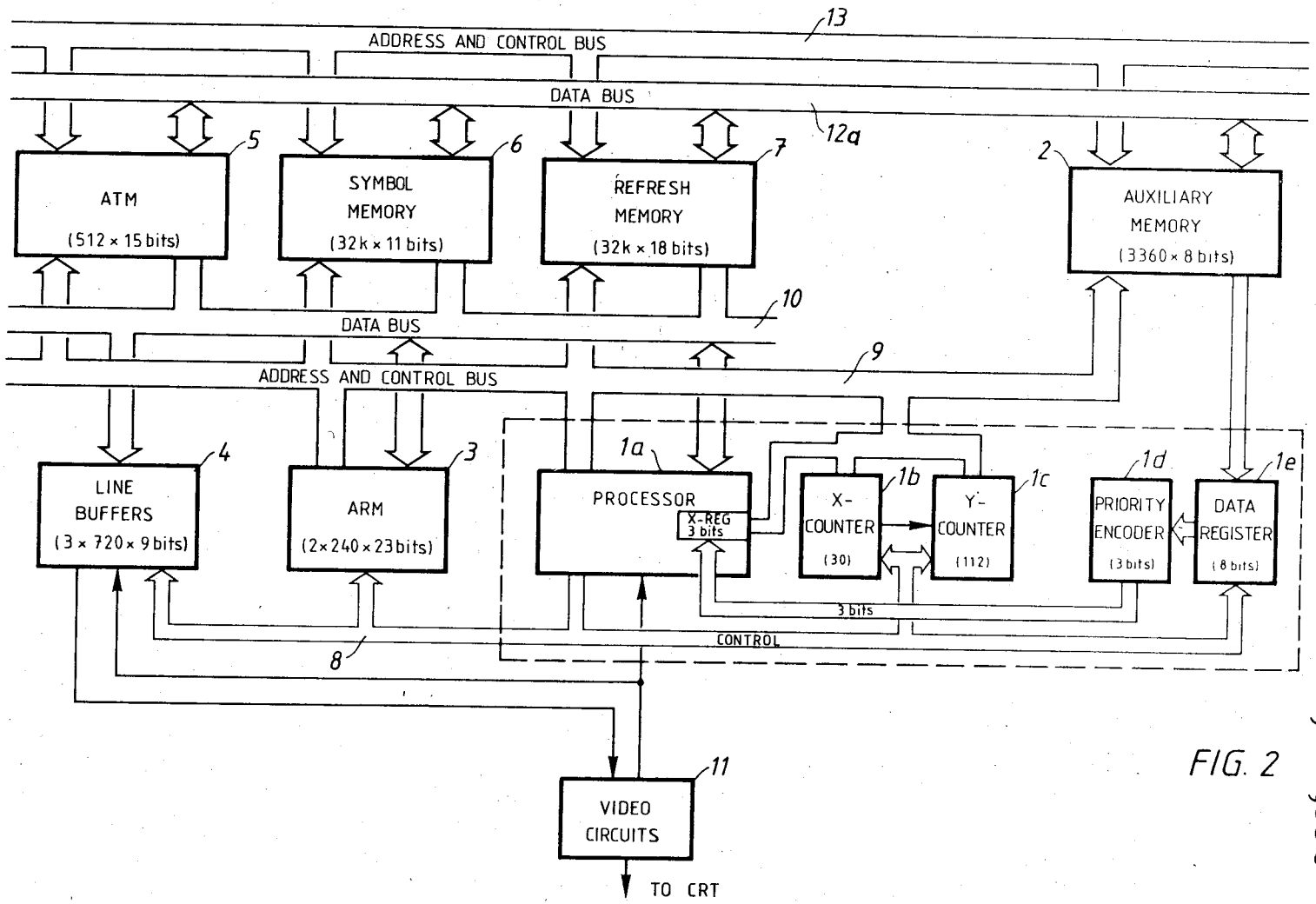
FIG. 2 shows in more detail one example of the VDU according to FIG. 1 as well as the data and information flow between the different units thereof.

FIG. 2 shows in more detail the build-up of the central parts in a VDU according to the invention. In the following, the invention is described starting from an imaginary example, in which the VDU is assumed to comprise 720 picture elements in the X-direction and 336 elements in the Y-direction. These picture elements are utilized in picture element matrices, here called tessels, each picture element matrix being square and comprising 3 times 3 picture elements. The image surface consequently comprises 240 times 112 tessels. The symbol repertory is assumed to be 512 different symbols. The auxiliary memory 2 is assumed to be oriented in the form of eight-bit words. The number of colors is 64. The different units in FIG. 2 thus have the following organization:

| | |
|---|---|
| Address transformation memory 5: | 512 words of 15 bits (symbol memory contains $2^{15}$ words). |
| Symbol memory 6: | 32,000 words of 11 bits (9 bits of pattern information + 2 link bits). |
| Refresh memory 7: | 32,000 words of 18 bits (9 bits of symbol code, 8 bits of color information, 1 definition or marking bit). |
| Auxiliary memory 2: | 3,360 words of 8 bits (1 bit for each tessel on the VDU). |
| Line buffers 4: | 3 times 720 times 9 bits (1 tessel = 3 raster lines, 720 image elements per raster line, each picture element having 9 bits, of which 8 bits are color information and 1 bit information). |
| Address reference memory 3: | 2 banks of each of 240 times 23 bits (240 tessels in X-direction, each with a possible address to the symbol memory, as well as 8 bits of color information for each tessel). |
| X counter 1b: | Counts up to 30 (number of words in X-direction in auxiliary memory 2). |
| Y counter 1c: | Counts up to 112 (number of tessel lines in Y-direction). |
| Priority encoder 1d: | 3 bits. |
| Data register 1e: | 8 bits (= word length in auxiliary memory). |

As will be clear from the above and from FIG. 2, the image processor 1 comprises a microprocessor 1*a*, an X counter 1*b*, a Y counter 1*c*, a priority encoder 1*d* and a data register 1*e*. The processor 1*a* controls the function of and the communication flow between the units 5, 6, 7, 2, 4, 3, 1*b*, 1*d* and 1*e* and the video circuits 11. The processor also comprises an X register with a capacity of 3 bits. The X counter 1*b* indicates the current X coordinate, counting in number of words in the auxiliary memory. Since each word in the auxiliary memory comprises 8 bits, the X counter counts in units of 8 tessels in the X-direction. The Y counter indicates the current Y coordinate counting in tessels. The data register 1*e* receives word by word from the auxiliary memory and stores each word. The priority encoder 1*d* is supplied with the word at present stored in the data register and indicates the most significant bit (MSB) of the word. The X register is supplied with this information and stores the information about the position of the most significant bit in the X-direction. The contents in the X counter 1*b* together with the contents in the X register therefore indicate the coordinate of the tessel in question in the X-direction. An address and control bus 9 as well as data bus 10 attend to the flow of control signals and information signals between the units 1, 2, 3, 4, 5, 6 and 7. The communication processor 12 controls the units 2, 5, 6 and 7 via an address and control bus 13, and the information flow between these units and the communication processor flows via a data bus 12*a*.

Each one of the two processors 1*a* and 11 may consist of a circuit of Motorola 6800/78000, Intel 8080/8086, or similar type. The refresh memory 7, the address transformation memory 5, the auxiliary memory 2, the line buffers 4 and the address reference memory 3 may consist of circuits of type 4116, 6116 or the like. The symbol memory 6 may consist of a circuit of type 2716, 2764 or the like. The priority encoder 1*d* may consist of a circuit of type 74148. The data register 1*e* may consist of a circuit of type 74273, 74373 or 74374.

Figure 3:
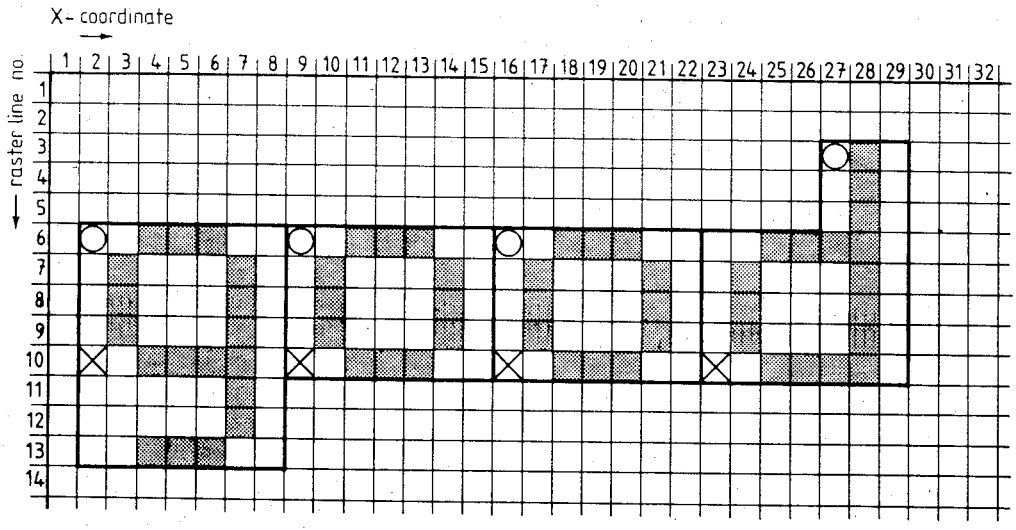
FIG. 3 shows one example of the presentation of a number of characters on a VDU according to the invention.

FIG. 3 shows an example of a character representation on a VDU of raster scan type. As an example the word "good" is shown written on the VDU. An "o" marks the coordinates which best fit the regeneration (refreshing) of the characters, i.e. the upper lefthand corner of each character, which is that part of the character first contacted by the electron beam when scanning the surface of the VDU. An "X" marks the coordinates which are most suitable for the reading out of the information contents of the image. From the point of view of information, the word "good" must be considered to be written on raster line 10. The "preserve" of each character is marked by thicker lines in FIG. 3.

Figure 4:
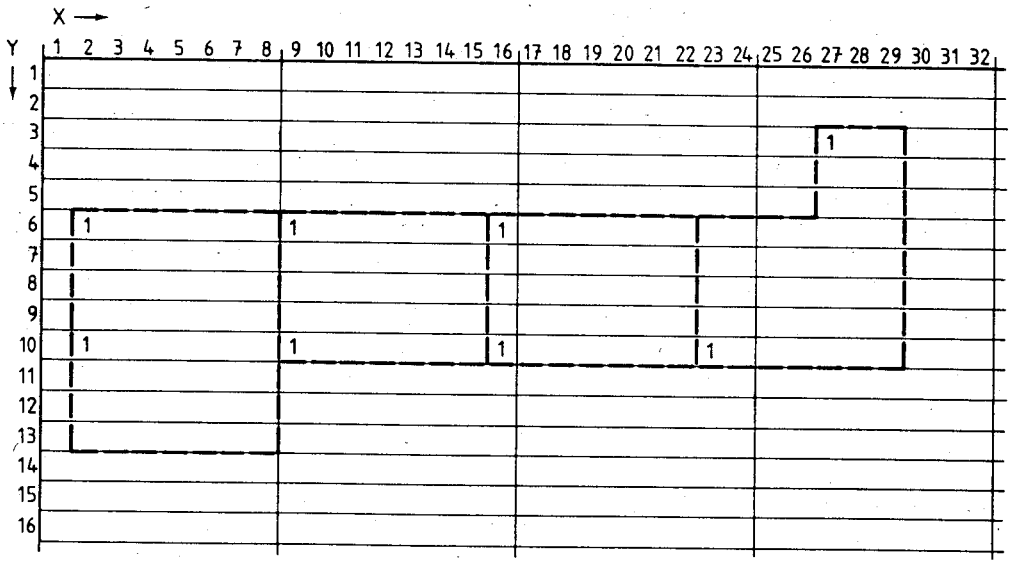
FIG. 4 shows the information contents of the auxiliary memory during display of the characters shown in FIG. 3.

FIG. 4 shows an example of information contents in the auxiliary memory 2 when presenting the image shown in FIG. 3. The upper lefthand corners of the four characters are denoted in the auxiliary memory by "ones" at the coordinates (3, 27), (6, 2), (6, 9) and (6, 16). The code positions are denotes by "ones" at the coordinates (10, 2), (10, 9), (10, 16) and (10, 23). In the other memory cells, "zeros" are stored. The "preserves" of the characters are shown in dashed lines in FIG. 4. The thicker vertical lines show the limits for the word division in the auxiliary memory, where each word occupies a width of 8 bits.

Figure 5:
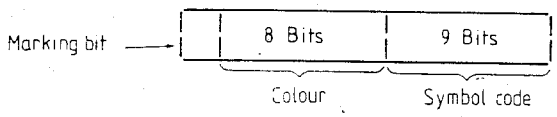
FIG. 5 shows the word format in the refresh memory, and FIGS. *6a*, *6b* and *6c* show the word formats in the symbol memory.

FIG. 5 shows the word format in the refresh memory. Each word has a length of 18 bits. The first so-called marking bit has the following meaning:

0: the upper lefthand corner of the symbol.

1: the definition field of the symbol.

The word further contains eight-bits of color information and a symbol code comprising nine bits.

Figure 6A:
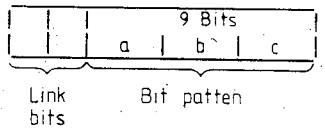
Figure 6A:
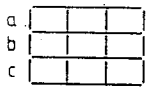

FIG. 6*a* shows the word format in the symbol memory 6, where each word has a length of 11 bits. The first two bits in the word, usually two words, constitute so-called link bits, which have the following meaning:

01: The symbol continues in the writing direction.

10: The symbol is temporarily terminated in the writing direction but continues on the next line.

11: The symbol is terminated.

In those cases where the link bits of the word constitute one of the three above-listed combinations, the remaining nine bits are information about the bit pattern for a tessel in the symbol in question. The first three bits then contain information about the line a in the tessel, the next three contain information about line b in the tessel, and the last three contain information about the last line, line c, in the tessel.

Figure 6B:
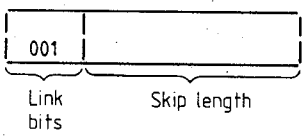

In two cases, the first three bits of the word constitute link bits. One of these cases is shown in FIG. 6*b*. The first three bits then have the combination 001, which indicates that the character is temporarily terminated but continues on the same writing line after a jump or skip of a certain length. The remaining eight bits of the word provide the information which defines the length of the skip.

Figure 6C:
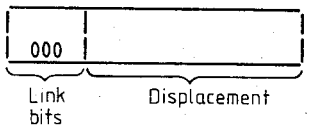

In the second case of a triple link bit (see FIG. 6*c*), the first three bits constitute a combination 000, which means that the character is terminated on the line in question and that the lefthand edge of the character on the next line is displaced relative to the lefthand edge of the character on the line in question. The remaining eight bits of the word indicate the character of and the size of this displacement.

Figure 7:
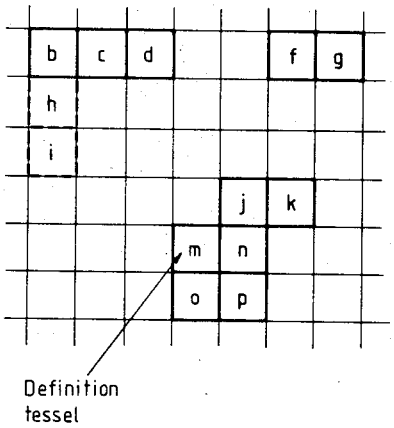
FIG. 7 shows one example of a symbol and its representation in the symbol memory, FIG. 8 indicates the relationship between the address transformation memory and the symbol memory.

FIG. 7 shows a further example of a symbol and its representation in the symbol memory 6. The symbol consists of 13 symbol matrices (tessels), each comprising 3 times 3 dots: b, c, d, f, g, h, i, j, k, m, n, o, p. The tessel denoted by a small m is the definition tessel of the symbol, which is used when reading out the information contents of the VDU. The symbol is described in the symbol memory by the 16 words from small a to small p, the significance of which is clear from the following table:

| Words in the symbol memory | | | Remark |
|---|---|---|---|
| a | 00 | +12 | Relative address to definition field (m) |
| b | 01 | DOT PATTERN | |
| c | 01 | DOT PATTERN | |
| d | 01 | DOT PATTERN | |
| e | 001 | +2 | Same line, skip 2 steps |
| f | 01 | DOT PATTERN | |
| g | 10 | DOT PATTERN | The symbol terminated in the writing direction |
| h | 000 | +0 | No displacement next line |
| i | 000 | +4 | Displacement +4, next line |
| j | 01 | DOT PATTERN | |
| k | 01 | DOT PATTERN | |
| l | 000 | −1 | Displacement −1, next line |
| m | 01 | DOT PATTERN | |
| n | 10 | DOT PATTERN | The symbol terminated in the writing direction |
| o | 01 | DOT PATTERN | |
| p | 11 | DOT PATTERN | The symbol terminated |

Figure 8:
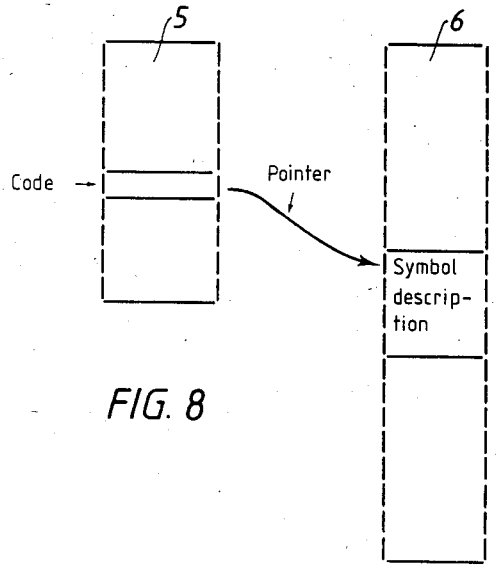

FIG. 8 shows the relationship between the address transformation memory 5 and the symbol memory 6. The address transformation memory 5 is addressed by a character code which indicates which of the 512 possible symbols is of immediate interest. In the address in the address transformation memory, indicated by the character code, there is stored a so-called pointer which points at or indicates the position in the symbol memory 6 where the description of the symbol starts. This means that the pointer contains the address to the first of the words in the symbol memory which contain information about the dot pattern of the symbol.

Figure 9:
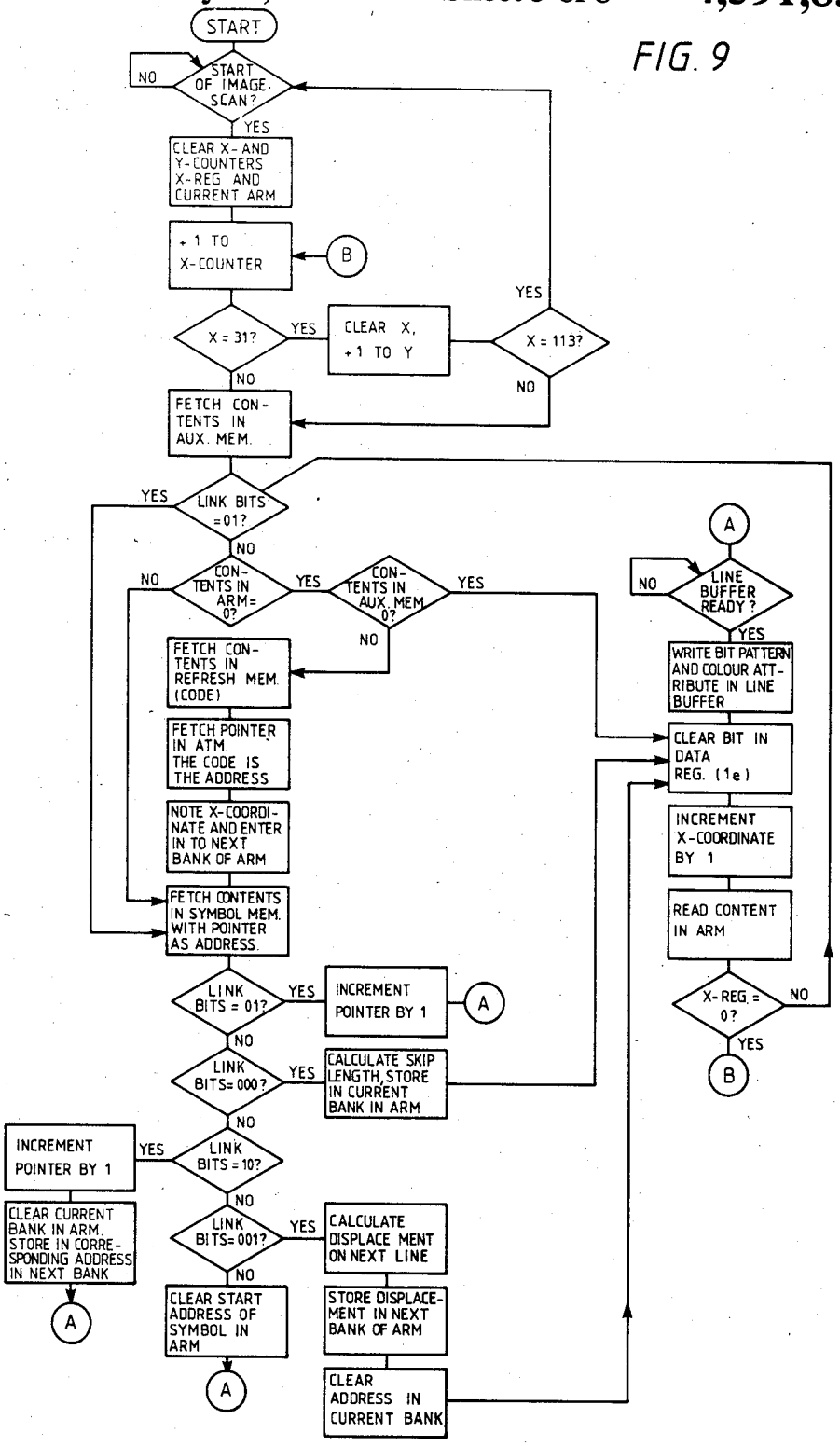
FIG. 9 is a flow diagram of the image processor for the VDU according to FIGS. 1 and 2 when regenerating (refreshing) the image.

FIG. 9 shows a flow chart which describes the function of the image processor when presenting an image on the VDU. The image is assumed to be stored in the refresh memory 7 and the auxiliary memory 2. During presentation of a constant and unchanged image, this takes place by writing the whole image on the VDU, for example 50, times per second. This repeated presentation of an unchanged image is called regeneration (refreshing). This process will be described below with reference to the flow chart in FIG. 9 and to the previously described figures.

In the initial position the line buffers 4, the address reference memory 3, the X and Y counters 1*b* and 1*c* and the data register 1*e* are cleared.

On the signal "start of image scan" from the video circuits 11, the X counter is incremented by "one" via the control lines 8. The contents of the X and Y counters are supplied to the address and control bus 9 and the auxiliary memory 2 is addressed. The first eight data bits are transferred to the data register 1e. If all the bits are zeros, the priority encoder 1d signals this to the processor 1a. The processor 1a again increments the X counter 1b by one and a new read access to the next address in the auxiliary memory 2 occurs. This is repeated for as long as the contents in the data register 1e are equal to zero (only zeros).

When the contents in the data register 1e for the first time contain at least one "one", the priority decoder 1d signals this to the processor 1a. In addition, the priority encoder gives the bit number of the bit which has been given the highest priority. Of necessity, this bit must represent the upper lefthand corner in the first encountered symbol (see FIG. 3).

The X and Y counters 1b/1c together with the three bits from the priority encoder 1d now constitute the address to the position in the refresh memory 7 which contains the code for the symbol encountered (see FIG. 5 for this format).

A read access to the above-mentioned address in the refresh memory 7 now takes place. The contents of this memory cell are read via the data bus 10 to the processor 1a. The processor 1a now has the code of the symbol. This code is used as the address to the address transformation memory 5. The address transformation memory 5 contains one memory cell for each conceivable code; in this example 512 cells. The addressed memory cell contains a pointer to the first address of the symbol description in the symbol memory 6 (see FIG. 8). This pointer is brought to the processor 1a whereby the following takes place: the pointer is written into the address reference memory 3 in that of the 240 positions which is indicated by the X counter 1b and the priority encoder 1d, and a read access occurs to the symbol memory 7. The contents in the addressed memory cell in the symbol memory contain on the one hand bit patterns, which are written in the correct positions in the line buffers 4 together with the color bits (in this example eight such bits) from the refresh memory, and on the other hand links bits (see FIG. 6). The link bits are examined by the processor 1a. If the character continues on the same tessel line (the link bits=01), the processor makes a new read acess to the next address, bit patterns and color are written into the next position in the line buffers 4.

In this situation, the process is completely controlled by the link bits which the processor 1a reads from the symbol memory 4:

A. As long as the link bits=01, the character continues on the same line. The processor therefore makes readings in consecutive addresses in the symbol memory 6 and the process described above proceeds.

B. When the link bits=000, a skip takes place, i.e. the symbol continues further on the same line (interrupted symbol). Otherwise, see FIG. 7. Instead of bit patterns, the address contains the length of the skip in the X-direction. The processor adds this length in its pointer to the line buffers 4 and makes a new read access to the next address in the symbol memory 6.

If the link bits now=01 or =000, the process continues according to A and B above. Otherwise, the continuation takes place according to C, D or E below.

C. If the link bits=10, the symbol is terminated on this line. The processor now abandons the currently started symbol. The start address of the symbol in the address reference memory 3 is set to zero in the first bank in the memory and the address to the next field in the symbol memory 5 is stored in the same address as the start address, but this time in the bank 2 of the address reference memory 3. The bit, which is indicated by the priority encoder 1d, is set to zero by the processor via the control lines 8 in the data register 1e. If there are several "ones" in the data register, the priority encoder will point out the next bit in the order of priority. The procedure described above will be repeated for the address indicated by the X and Y counters and the priority encoder.

When all the "ones" in the data register have been processed, the processor increases the contents in the X counter by one and a new address in the auxiliary memory 2 is read down to the data register 1e. The procedure then continues from the beginning of this description.

D. If the link bits=001, the character is terminated on this line and the remainder of the word constitutes displacement on the next line in relation to the start address of the symbol. The processor computes this displacement, and the result constitutes the address to the bank 2 of the address reference memory 3. In this address, the processor stores the address to the next field of the symbol in the symbol memory 5.

The start address of the symbol in the bank 1 is now also set to zero by the processor.

The continued processing of the data register 1e takes place as described under C above.

E. If the link bits=11, the symbol is terminated and the processor simply sets the start address of the symbol to zero on this line. Thereby the symbol is completely terminated for this refresh cycle.

When the line buffers 4 are completely filled, the processor 1a assumes an idle position. Gradually, the video circuits 11 start reading out and processing of the contents in the line buffers 4 for presentation on the VDU (CRT). As soon as reading from the line buffers 4 has started, the processor can resume the filling up of the line buffers. The video circuits 11 signal continuously to the processor when refilling for the next information line can take place.

When the whole first line of tessels has been drawn on the VDU, the whole procedure starts again from the beginning. However, there is one important difference in the working procedure compared with the first line, namely, the processing of the address reference memory 3.

During the second line, the process reads address by address in the bank 2 of the address reference memory 3. If the contents differ from zero, the address to the next field in the symbol memory 6 for a commenced but not terminated symbol is to be found here. Otherwise, the processing takes place according to the description above. A commenced symbol always has priority before a new symbol from the auxiliary memory 2. A new "one" within the "preserve" of a symbol only indicates the code position of the character and requires no special processing (cf. FIG. 4).

During the second line, the bank 1 of the address reference memory 3 constitutes the continuation of the characters. Henceforth the processor alternates between these two banks depending on whether the line in question is an odd or an even line.

When the X counter 1b has counted up to 30, the Y counter 1c has counted up to 112 and the data register 1e has been set to zero, a new refresh cycle can be started.

As a special case, the upper lefthand corner of a symbol and its code position may coincide. In that position the refresh memory contains "one" in the most significant bit MSB of the word (see FIG. 5). This special case involves no complication for, and requires no special processing of, the processor 1*a*, but MSB is only intended as an aid to the communication processor in identifying the code position of the symbol.

Figure 10:
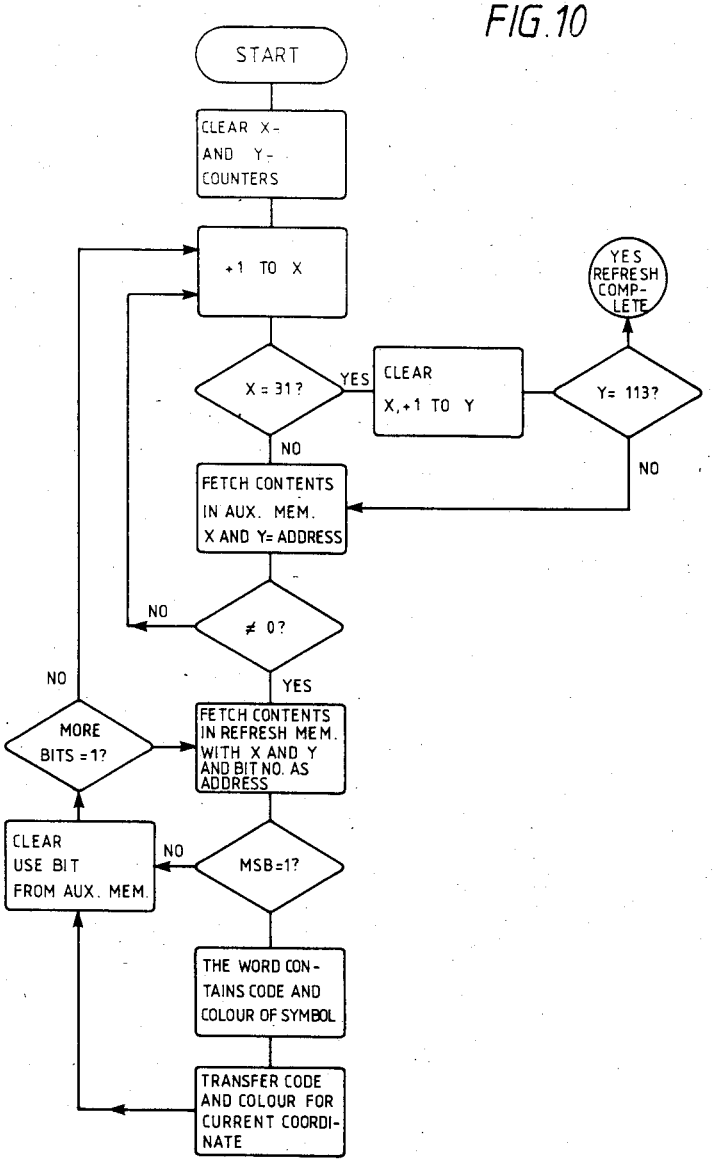
FIG. 10 is a flow diagram for the image processor when reading out the information contents of the image.

FIG. 10 shows a flow diagram for reading out the information contents of an image. The reading is performed by the communication processor 12. The flow diagram shows reading out of the information contents of the whole image.

Figure 11:
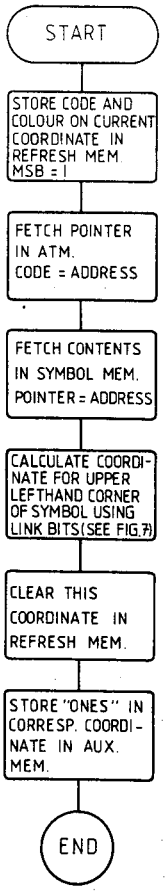
FIG. 11 is a flow diagram for the image processor when storing a new symbol in the image.

FIG. 11 shows a flow diagram for storing a symbol in the image. The storing is performed by the communication processor 12. The code and coordinate of the symbol are known (are obtained from an external source). In the first square in the flow diagram, after "start", the designation MSB occurs, by which is meant the most significant bit. With regard to the fourth square in the diagram after "start", it should be noted that since the definition tessel of the symbol is known, it is then possible to count backwards from this to the coordinate for the upper lefthand corner of the symbol with the aid of the link bits. With regard to the fifth square after "start", it may be mentioned that in this place the most significant bit has to be set to 0. As to the sixth square after "start", it should be mentioned that "ones" must be written in the places for the upper lefthand corner of the symbol and for its definition tessel.

Figure 12:
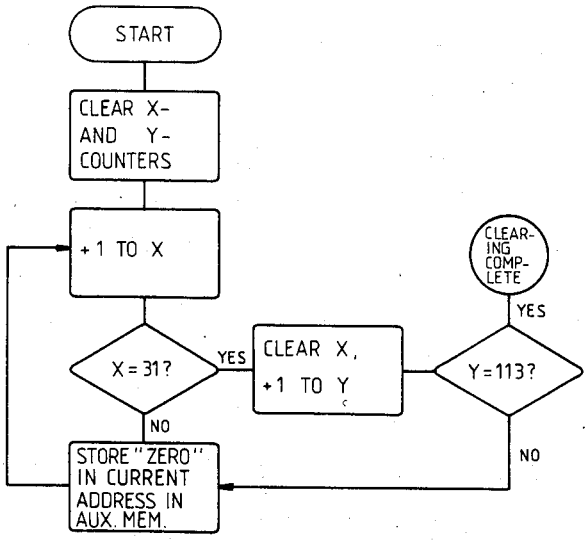
FIG. 12 is a flow diagram for the image processor when clearing a whole image.

FIG. 12 shows a flow diagram for the clearing of a whole image. This is carried out by the communication processor 12. Only the auxiliary memory need be cleared to achieve this goal, and the refresh memory need not be interfered with.

As will be clear from the above description, the invention provides great advantages for a device described here. These advantages are substantially the following:

The conflict between refreshing of symbols and reading of the information contents of the image is eliminated.

Writing and clearing of symbols are simplified as these operations are controlled merely by storing and clearing, respectively, in the auxiliary memory.

Clearing of a full image is performed more rapidly (fewer accesses required).

The refresh of the image is simplified.

The storing and reading in of the image are simplified.

Editing of the image is simplified and accelerated since only the auxiliary memory need be processed.

The VDU can be simply adapted to other languages with write directions different from those described above, for example from right to left, column by column, etc.

Within the scope of the invention, a device for display on a VDU can be designed in many different ways. For example, if desired, two separate auxiliary memories can be arranged, one for the definition elements and one for the start elements. Further, the auxiliary memory or the auxiliary memories need not be physically separated from the refresh memory, but it is assumed that, in order to attain the advantages of the invention, they shall be logically separated from the refresh memory.

What is claimed is:

1. A device for presenting graphical information in the form of dot matrix symbols of arbitrary shape and size on a presentation unit of the raster scan type, comprising, a symbol memory, in which information about the dot patterns of the available symbols is stored, and a refresh memory, in which information is stored about the position of the symbols included in an image, characterized in that the devices also comprises, an auxiliary memory, storing for each symbol occurring on the image, information about the position in the image, including a start element for presentation of the symbol, the start element being that element of the symbol which is first written during presentation, and a definition element identifying a position in the refresh memory, which corresponds to the position of the definition element in the image, at which position of the refresh memory there is stored a code which identifies the symbol.

2. A device according to claim 1, in which the refresh memory contains one word for each picture element position on the VDU, the auxiliary memory being a memory separated from the refresh memory which, like the refresh memory, contains one word for each picture element position on the VDU.

3. A device according to claim 2, in which the word length in the auxiliary memory is smaller than in the refresh memory.

4. A device according to claim 3, in which the word length in the auxiliary memory is one bit.

5. A device according to claim 1, which further includes means responsive to said symbol and refresh memories for presentation of an image, means to scan the auxiliary memory and, on an indication that a certain picture element is a start element for a symbol, to pick up the code of the symbol in the corresponding position in the refresh memory.

6. A device according to claim 1, which further includes means responsive to said symbol and refresh memories for reading information defining an image, means to scan te auxiliary memory and, on an indication that a certain picture element is the definition element of a symbol, to fetch the code of the symbol in the corresponding position in the refresh memory.

* * * * *